US007267186B2

(12) United States Patent
Dick

(10) Patent No.: US 7,267,186 B2
(45) Date of Patent: Sep. 11, 2007

(54) MAGNETIC FACE SEAL FOR ROCK DRILL BIT BEARINGS

(75) Inventor: Aaron J. Dick, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 244 days.

(21) Appl. No.: 11/212,244

(22) Filed: Aug. 26, 2005

(65) Prior Publication Data

US 2007/0045008 A1 Mar. 1, 2007

(51) Int. Cl.
*E21B 10/25* (2006.01)

(52) U.S. Cl. ..... 175/371; 175/374; 277/378

(58) Field of Classification Search ..... 175/359, 175/371, 374; 277/302, 378
See application file for complete search history.

(56) References Cited

U.S. PATENT DOCUMENTS 5,078,411 A 1/1992 Geco
5,730,447 A 3/1998 Dawson et al.
6,401,843 B1 * 6/2002 Besson et al. ..... 175/359
6,684,966 B2 2/2004 Lin et al.
6,805,358 B2 10/2004 Dawson et al.

FOREIGN PATENT DOCUMENTS

SU 1687761 A1 * 10/1991

* cited by examiner

*Primary Examiner*—Kenneth Thompson
(74) *Attorney, Agent, or Firm*—Bracewell & Giuliani LLP

(57) ABSTRACT

A seal assembly for an earth boring bit uses a magnet to provide a desired contact force. The seal is located between a rotating cone and a stationary bearing pin of the drill bit. The seal has a non rotating metal face that is in sliding engagement with a seal face in the cone that rotates with the cone. The non rotating seal face is provided by a carrier ring that encircles the bearing pin. A magnet is mounted to the carrier ring to provide an attraction force maintaining the carrier ring in contact with the rotating seal face in the cone. An elastomeric seal ring seals between the carrier ring and the bearing pin to prevent rotation of the carrier ring.

20 Claims, 3 Drawing Sheets

MAGNETIC FACE SEAL FOR ROCK DRILL BIT BEARINGS

FIELD OF THE INVENTION

This invention relates in general to rotating cone earth boring bits, and in particular to a bit having a magnetic metal face bearing seal.

BACKGROUND OF THE INVENTION

One type of earth boring bit has at least one rotatable cone, typically three. The cones are mounted on depending bearing sections. As the bit body is rotated about the bit axis, each cone rotates about its bearing pin axis. A lubricant chamber supplies lubricant to the bearing spaces between the cone and the bearing pin. A seal adjacent the mouth of the cone seals lubricant from leakage to the exterior as well as sealing bore hole drilling fluid from entering the lubricant chamber.

One type of seal employs metal faces in sliding contact with each other. One of the metal faces is pressed against the other by an elastomeric energizer ring. While successful, some axial play occurs between the bearing pin and the cone, particularly after the bit has been drilling for an extended time. This fluctuating axial play will cause the energizing force supplied by the elastomeric energizing ring to also fluctuate, contributing to leakage and seal failure.

Metal face seals having magnets are commercially available for general industrial applications. These magnets are mounted to one of the seal members to attract the opposite seal member. Applicant is not aware of any earth-boring bits utilizing magnetic metal face seals.

SUMMARY OF THE INVENTION

In this invention, the earth boring drill bit seal assembly has a rotating and a non rotating seal member, each having metal face in sliding engagement with the other. A magnet is carried by one of the seal members to attract the other seal member into dynamic sealing engagement. In one embodiment, the magnet is mounted to the face of the non rotating member. An elastomeric seal seals debris and drilling fluid from contact with the magnet.

In one embodiment, the magnet is recessed from the seal face so that it will not contact the metal seal face of the other member. In another embodiment, the magnet has a face mounted flush with the metal seal face. A coating is applied to the face of the magnet as well as to the seal face of the member to which the magnet is mounted. This coating is of a hardened wear-resistant material such as diamond or diamond like carbon coating. In that embodiment, the coated face of the magnet slidingly engages the opposite metal face.

In still another embodiment, the seal assembly includes a conventional, elastomeric energizer ring. The energizer ring creates a force component that is coaxial with the bearing pin axis to force the rotating seal member against the non rotating seal member. A magnet is used in conjunction with the energizer ring for maintaining the seal members in engagement with each other should the force of the energizing ring drop below a desired amount. That embodiment also may employ a backup elastomer to block drilling fluid and debris from contact with the energizer ring as well as the magnet.

DETAILED DESCRIPTION OF THE INVENTION

Figure 1:
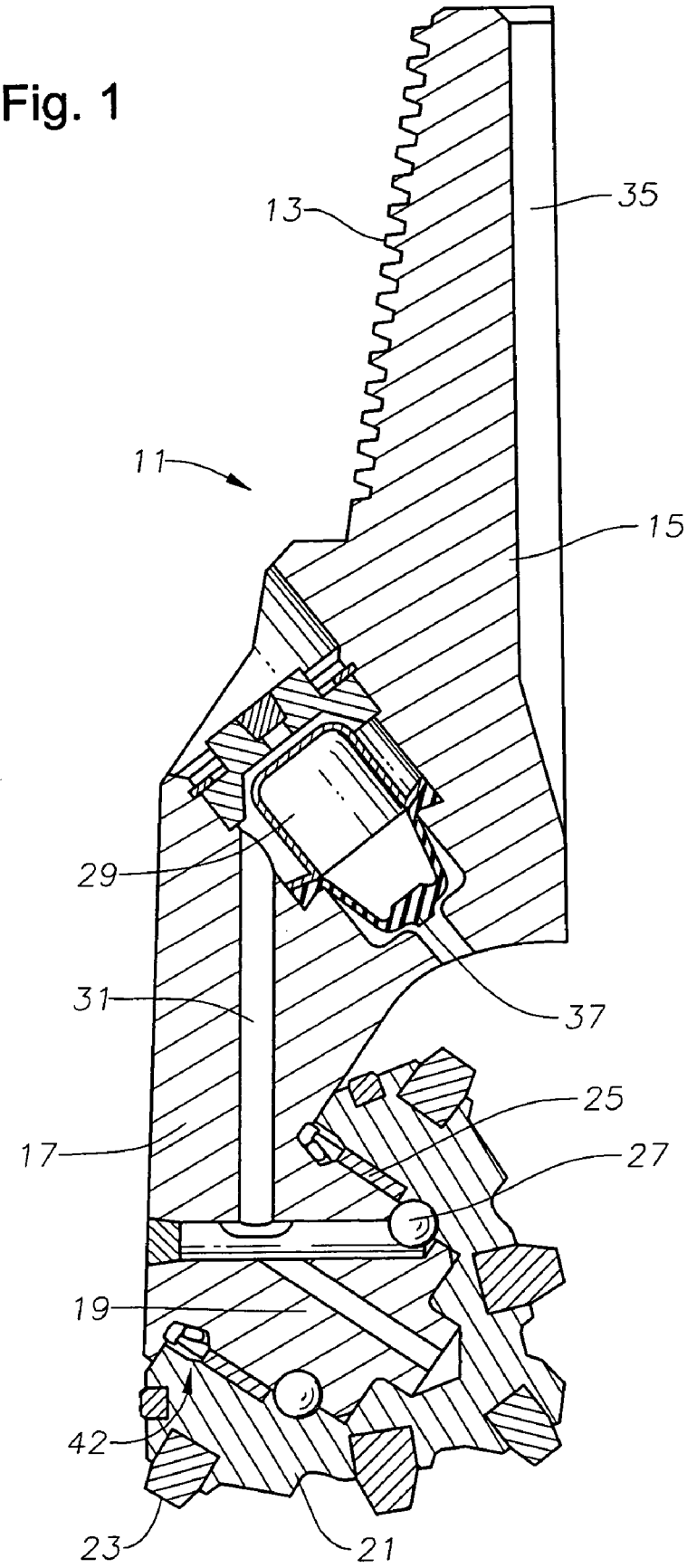
FIG. 1 is a quarter sectional view of an earth boring bit constructed in accordance with this invention.

Referring to FIG. 1, bit 11 has a threaded pin 13 for connection into a drill string (not shown here). Bit 11 has a body 15 with at least one depending leg 17, typically three. A bearing pin 19 extends downward and forward toward the bit axis of rotation (not shown). Bearing pin 19 is a generally cylindrical member integrally formed on each bit leg 17.

A cone 21 mounts to each bearing pin 19 for rotation relative to bearing pin 19. Cone 21 has cutting elements 23, which may be either tungsten carbide inserts as shown or machined steel teeth. In this embodiment, cone 21 has a bearing sleeve 25 that is press-fitted within its cavity for forming a journal bearing with bearing pin 19. Alternately, the bearing surface within cone 21 could be integrally formed with cone 21. Cone 21 is locked to bearing pin 19 in this embodiment by a plurality of balls 21 to reduce axial movement or play of cone 21 on bearing pin 19.

A lubricant chamber 29 holds viscous grease that is dispensed through lubricant passages 31 to the spaces in and surrounding bearing sleeve 25 on bearing pin 19. Normally, each bit leg 17 has one of the lubricant chambers 29. A drilling fluid passage 35 extends through body 15 for pumping drilling fluid or mud downward and out nozzles (not shown) at the lower end of body 15. Drilling fluid flows around cones 21 and back up the borehole. A pressure compensator 37 is mounted in lubricant chamber 29. Compensator 37 includes an elastomer that seals between the grease in lubricant chamber 29 and drilling fluid on the exterior of bit 11. Compensator 37 also tends to equalize the pressures on the exterior and the interior of lubricant chamber 29.

Cone 21 has a back face 39 that defines an annular mouth or entrance to its cavity. Back face 39 is closely spaced, but not touching a last machined surface 41 formed at the junction of bearing pin 19 and bit leg 17. A small clearance exists between back face 39 and last machined surface 41. A seal assembly 42 is located in the mouth of cone 21 adjacent back face 39 for sealing the mouth of cone 21 to bearing pin 19.

Figure 2:
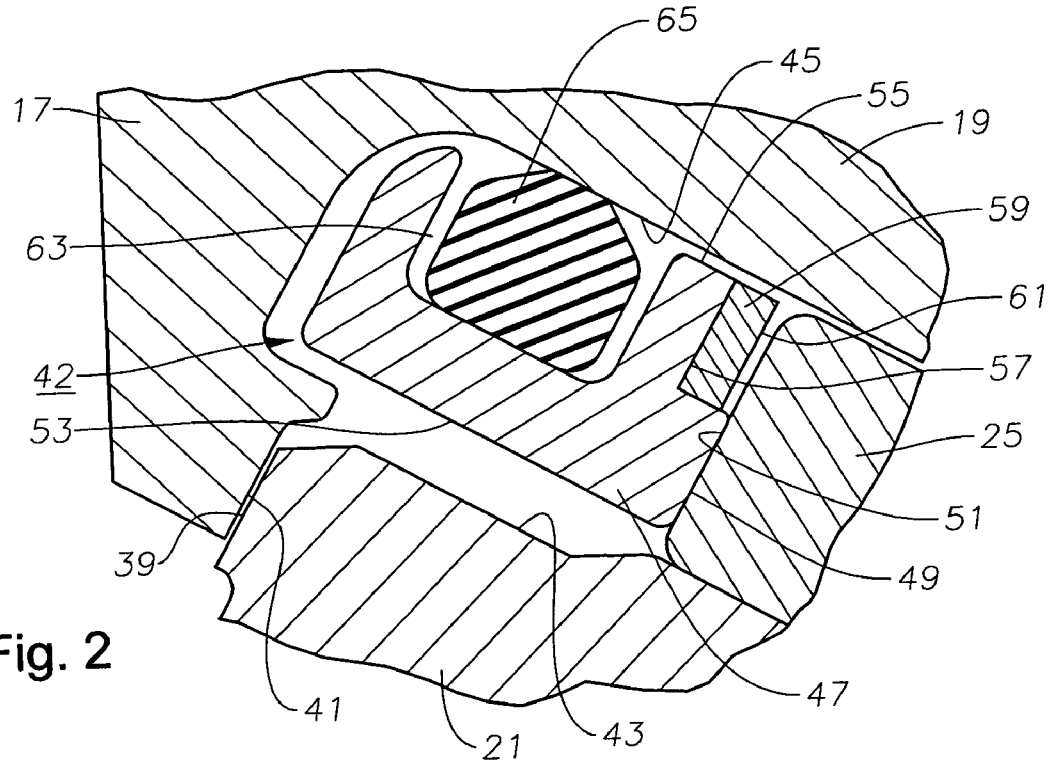
FIG. 2 is an enlarged sectional view of a first embodiment of the seal assembly for the boring bit of FIG. 1.

FIG. 2 shows a first embodiment of a seal assembly 42. Seal assembly 42 is located in a seal gland or groove that is defined by a cone gland surface 43 and a stationary bearing pin gland surface or groove 45. Cone gland surface 43 is located radially outward from bearing pin gland surface 45 relative to an axis of bearing pin 19.

A carrier ring 47 is located in the gland between surfaces 43 and 45. Carrier ring 47 is a rigid ring, preferably formed of a nonmagnetic metal material in this embodiment. Carrier ring 47 has a non rotating seal face 49 that engages in dynamic sliding contact with a rotating seal face 51. Rotating seal face 51 is located on an end of bearing sleeve 25 in this embodiment and thus rotates with cone 21. Carrier ring 47 has an outer diameter portion 53 that is spaced radially inward from cone gland 43 by a clearance. Carrier ring 47 has an inner diameter portion 55 that is spaced radially outward by a clearance from bearing pin gland surface 45.

A recess 57 is formed in the forward facing end of carrier ring 47 adjacent seal face 49. In this embodiment, recess 57 is annular and extends from inner diameter portion 55 outward to about half the thickness of carrier ring 47. An annular magnet 59 is secured within recess 57 by suitable means, such as an adhesive. Magnet 59 is a strong permanent magnet and may be of a variety of conventional materials. Magnet 59 has a face 61 that is recessed rearward from rotating seal face 51, providing a clearance. Magnet face 61 is thus not in sliding contact with rotating seal face 51 in this embodiment. Although described as annular, magnet 59 could alternately comprise a plurality of circular disks or cylindrical rods spaced circumferentially apart from each other around carrier ring 47. Bearing sleeve 25 is of a ferrous material. Thus, magnet 59 is attracted to it and has sufficient strength to maintain seal face 49 in dynamic contact with bearing sleeve 25 at a desired force or pressure.

Carrier ring 47 has a groove 63 formed in its inner diameter portion 55 that contains a seal ring 65. Seal ring 65 is deformed against bearing pin gland surface 45 to prevent rotation of carrier ring 47 but allow some radial play relative to the axis of bearing pin 19. Also, seal ring 65 seals against the entry of cuttings, debris and drilling fluid into contact with magnet 59. In this embodiment, seal ring 65 does not provide any energizing force tending to force seal face 49 against seal face 51.

Lubricant is contained within the lubricant chamber 29 (FIG. 1), passage 31 and throughout clearances within the bearing assembly. The lubricant immerses magnet 59 and is in contact with the inner side of seal ring 65. The lubricant pressure is normally slightly higher than the exterior pressure. Drilling fluid and debris are blocked from contact with the lubricant and magnet 59 by seal ring 65. The sealing engagement of faces 49 and 51 prevents the lubricant from leaking to the exterior.

In the operation of the embodiment of FIG. 2, when bit 21 revolves about its bit axis, cone 21 will rotate about the axis of bearing pin 19. Bearing sleeve 25 rotates with cone 21. Magnet 59 provides a continuous attraction that forces faces 49 and 51 to remain in dynamic sealing engagement with each other even if excessive axial play of cone 21 relative to bearing pin 19 occurs. Carrier ring 47 will move axially in unison with any axial play of cone 21.

Although magnet 59 has been shown mounted to carrier ring 47, it could alternately be mounted in a recess in bearing sleeve 25 for rotation with bearing sleeve 25. In that instance, bearing sleeve 25, or at least a portion of it, would be of a non magnetic material, and carrier ring 47, or at least a portion of it, would be of a ferrous metal.

Figure 3:
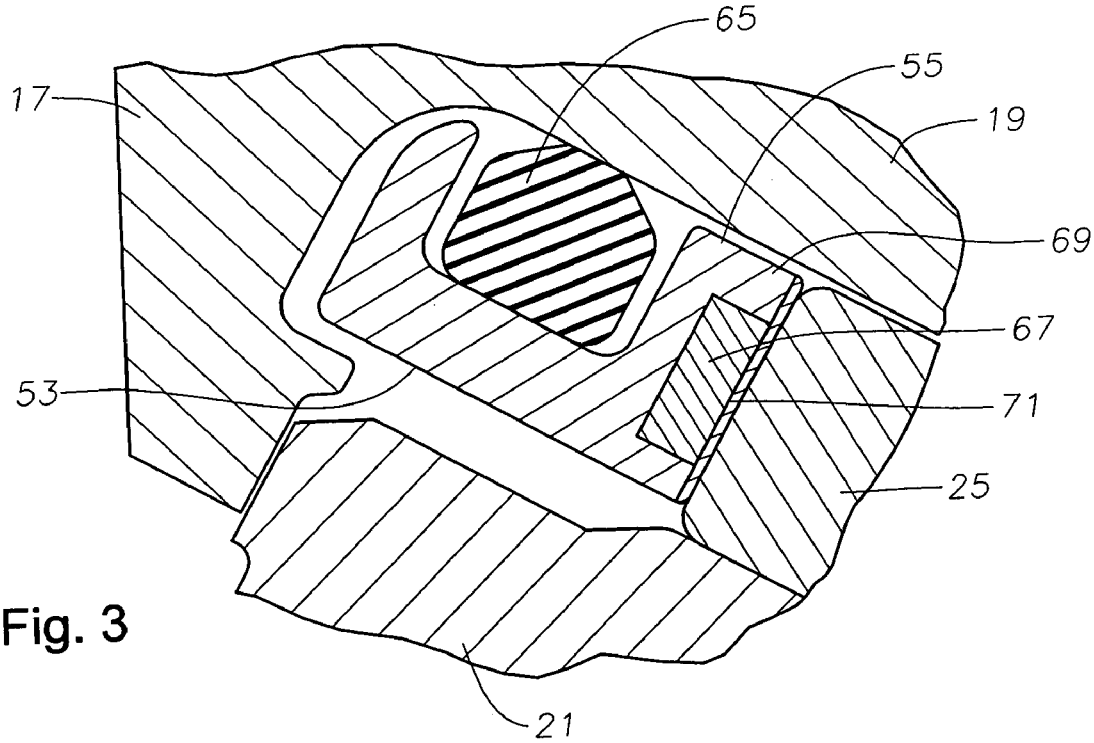
FIG. 3 is an enlarged sectional view of a second embodiment of a seal ring for the earth boring bit of FIG. 1.
Figure 4:
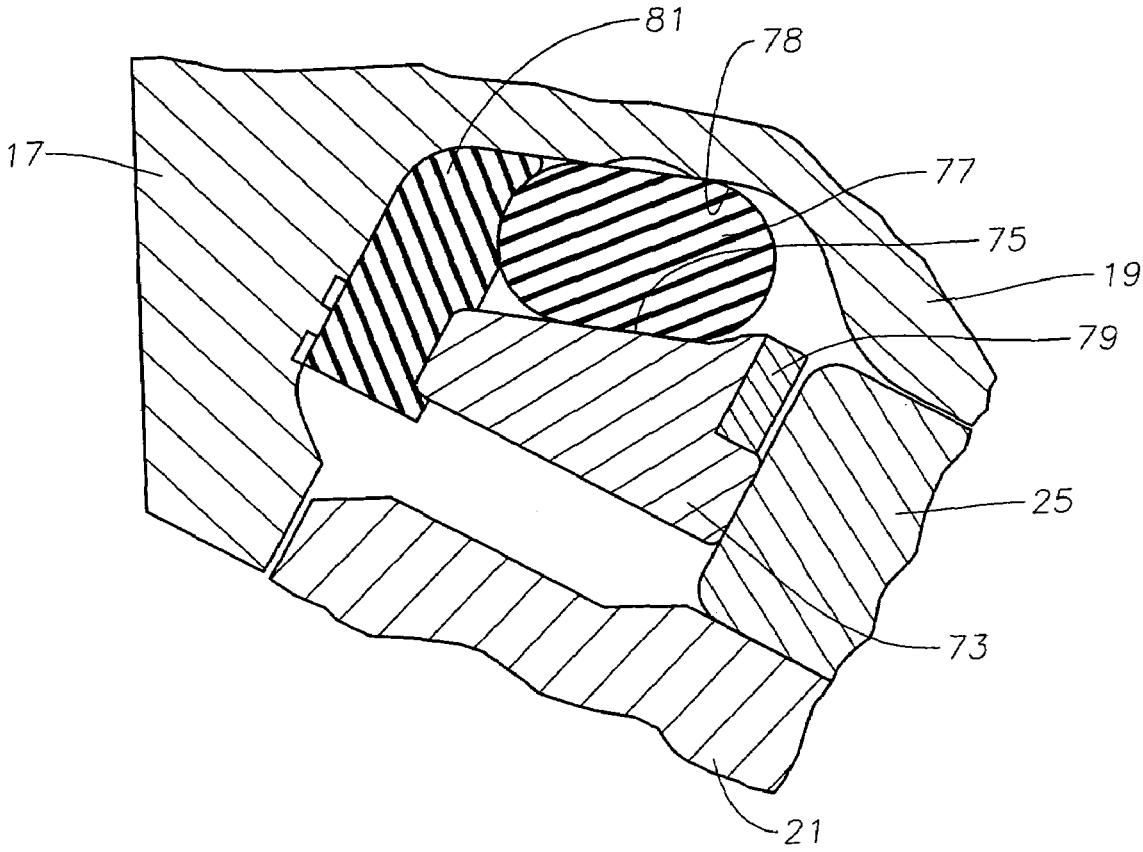
FIG. 4 is a sectional view of a third embodiment for the seal ring of the earth boring bit of FIG. 1.

In the embodiments of FIGS. 3 and 4, elements that are substantially the same as in FIGS. 1 and 2 utilize the same number. In FIG. 3, carrier ring 69 has a recess in its forward face that contains a magnet 67. In this embodiment, magnet 67 has a face that is flush with the face of carrier ring 69. Also, preferably a coating 71 of hard wear resistant material is formed over the flush faces of carrier ring 69 and magnet 61. Coating 71 may be formed by a vapor deposition process, such as CVD, or other processes. Coating 71 may be diamond, diamond-like carbon, or any other suitable coating. Also, in FIG. 3, magnet 67 is shown spaced equally between the inner and outer diameter portions of carrier ring 69. However, it could be located nearer the inner diameter portion as in FIG. 2, if desired.

Referring to FIG. 4, carrier ring 73 has an inner diameter portion 75 that is conical. An elastomeric energizer ring 77 is deformed between carrier ring conical surface 75 and bearing pin gland surface 78. Bearing pin gland surface 78 is also conical and at substantially the same taper as conical portion 75 of carrier ring 73. Because of the deformation of energizer ring 77, a component of the force is directed downward and forward parallel to the axis (not shown) of bearing pin 19. Preferably, energizer ring 77 provides substantially the same amount of force as in the prior art type to cause dynamic sealing engagement of the faces of carrier ring 73 and bearing sleeve 25.

A magnet 79 is mounted to carrier ring 73. Magnet 79, similar to magnet 59, may be annular or it may comprise a plurality of circular disks or cylindrical rods spaced around carrier ring 73. Magnet 79 in this embodiment is recessed as in the embodiment of FIG. 2; however, it could be flush and contain a coating as in the embodiment of FIG. 3. Magnet 79 provides a backup magnetic force in the case of axial play of cone 21 diminishing the force provided by energizer ring 77 below tolerances. Also, in FIG. 1, a backup elastomer seal 81 is shown in contact with the rearward end of carrier ring 73 and the rearward side of energizer ring 77. Backup ring 81 is deformed against a portion of bearing pin gland surface 78 and provides a seal to prevent the entry of drill cuttings into contact with the exterior side of energizer ring 77.

The invention has significant advantages. The magnet provides a retentive force that maintains the seal faces in dynamic sliding engagement with each other. The retentive force causes the carrier ring to move axially slightly in unison with any axial play of the cone, thus maintaining sealing engagement even though axial play becomes significant. The magnet can be combined with a conventional energizer elastomer that provides the primary energizing force, with the magnet providing the secondary backup force in the event that the elastomer begins to fail to achieve the desired contact pressure of the seal faces.

While the invention has been shown in only a few of its forms, it should apparent to those skilled in the art that it is not so limited but it is susceptible to various changes without departing from the scope of the invention.

The invention claimed is:

1. An earth boring bit, comprising:

a body having at least one depending bit leg;

at least one bearing pin extending from the bit leg;

a cone mounted on the bearing pin for rotation about an axis of the bearing pin;

a lubricant chamber in the body for containing lubricant, the lubricant chamber having passages leading to spaces between the bearing pin and the cone;

a rotating seal member in the cone that rotates with the cone;

an annular non rotating seal member carried around the bearing pin and in sliding sealing engagement with the rotating seal member to prevent entry of well fluid into the lubricant chamber; and a magnet carried by one or both of the seal members to attract the seal members into dynamic engagement with each other.

2. The bit according to claim 1, wherein the magnet is immersed in the lubricant of the lubricant chamber.

3. The bit according to claim 1, wherein the seal members have seal faces that slidingly engage each other, and wherein the magnet has a face recessed from the seal face of the seal member by which it is carried.

4. The bit according to claim 1, wherein:

the magnet has a face that slidingly engages a seal face of one of the seal members and contains a hard wear resistant coating.

5. The bit according to claim 1, wherein:

the magnet has a face that slidingly engages a seal face of one of the seal members, is flush with the seal face of the seal member by which it is carried; and a hard, wear resistant coating is located on the face of the magnet and the seal face of the seal member that carries the magnet.

6. The bit according to claim 1, wherein the magnet is annular and extends around the bearing pin.

7. The bit according to claim 1, further comprising:

an elastomeric ring between the bearing pin and the non rotating seal member, the elastomeric ring exerting a force that has a component urging the non rotating seal member against the rotating seal member.

8. The bit according to claim 1, wherein the magnet is annular and mounted to the non rotating seal member such that the magnet encircles the bearing pin.

9. The bit according to claim 1, further comprising:

a first elastomeric seal that-seals between the non rotating seal member and the bearing pin; and a second elastomeric seal in sealing contact with the bearing pin, the non rotating seal member and the first elastomeric seal for blocking the entry of drilling fluid into contact with the first elastomeric seal.

10. An earth boring bit, comprising:

a body having at least one depending bit leg;

at least one bearing pin extending from the body;

a cone mounted on the bearing pin for rotation about an axis of the bearing pin;

a lubricant chamber in the body for containing lubricant, the lubricant chamber having passages leading to spaces between the bearing pin and the cone;

a seal gland between the bearing pin and the cone at a mouth of the cone;

a rotating seal member mounted for rotation with the cone and having a seal face in the seal gland;

a non rotating seal member carried around the bearing pin in the seal gland, the non rotating seal member having an inner diameter surface radially spaced from the bearing pin and an outer diameter surface radially spaced from the cone, relative to the axis of the bearing pin, the non rotating seal member having a seal face in sliding sealing contact with the seal face of the rotating seal member to prevent entry of well fluid into the lubricant chamber;

an elastomeric ring in the seal gland that seals between the bearing pin and the non rotating seal member; and a magnet carried by the non rotating seal member, the magnet exerting a force that urges the non rotating seal member toward the rotating seal member.

11. The bit according to claim 10, wherein the magnet has a face recessed from the seal face of non rotating seal member.

12. The bit according to claim 10, wherein:

the magnet has a face that slidingly engages the seal face of the rotating seal member and contains a coating of a hard, wear resistant material.

13. The bit according to claim 12, wherein:

the coating is selected from a group consisting of diamond and diamond like carbon.

14. The bit according to claim 10, wherein the magnet is annular and extends around the bearing pin.

15. The bit according to claim 10, wherein the elastomeric ring exerts a force that has a component urging the seal face of the non rotating seal member against the seal face of the rotating seal member.

16. The bit according to claim 15, further comprising an elastomeric back up ring in the seal gland that seals between the bearing pin, the elastomeric ring and the non rotating seal member.

17. In an earth boring bit having at least one bearing pin, a cone mounted on the bearing pin for rotation about an axis of the bearing pin, a seal gland between the bearing pin and the cone at a mouth of the cone, a rotating seal member in the seal gland that rotates with the cone, and an annular non rotating seal member carried around the bearing pin in the seal gland and having a seal face in sliding sealing contact with a seal face of the rotating seal member, the improvement comprising:

a recess formed in the seal face of the non rotating seal member;

a magnet mounted in the recess, the magnet exerting a force that urges the seal face of the non rotating seal member into sliding engagement with the seal face of the rotating seal member;

a seal groove located on an inner diameter portion of the non rotating seal member; and an elastomeric seal ring located in the groove and deformed against the bearing pin.

18. The bit according to claim 17, wherein the magnet has a face that is in a plane parallel to the seal faces but recessed within the seal face of the non rotating seal member.

19. The bit according to claim 17, wherein the magnet has a face that is flush with the seal face of the non rotating seal member, and wherein the face of the magnet and the seal face of the non rotating seal member are coated with a coating of a hard, wear resistant material.

20. The bit according to claim 17, wherein the magnet is annular and extends around the bearing pin.

* * * * *